US010546440B1

(12) United States Patent
Shen

(10) Patent No.: US 10,546,440 B1
(45) Date of Patent: Jan. 28, 2020

(54) CONTROL SYSTEM AND CONTROL METHOD FOR DOOR ACCESS CONTROL AND PERSONAL PHYSIOLOGICAL MONITORING

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 16/244,216

(22) Filed: Jan. 10, 2019

(30) Foreign Application Priority Data

Nov. 2, 2018 (TW) ..... 107138900 A

(51) Int. Cl.
*G07C 9/00* (2006.01)

(52) U.S. Cl.
CPC ..... *G07C 9/00111* (2013.01); *G07C 9/00071* (2013.01)

(58) Field of Classification Search
CPC ..... G07C 9/00111; G07C 9/00071; G07C 9/00158; G07C 9/00142; H04L 63/0861; H04N 5/247; H04N 5/265; G06K 9/00221; A61B 5/1176; A61B 5/7475
See application file for complete search history.

(56) References Cited

U.S. PATENT DOCUMENTS

2015/0373018 A1* 12/2015 Lippens ..... G06K 9/00087 726/7
2016/0180618 A1* 6/2016 Ho ..... G07C 9/00563 340/5.52
2016/0183812 A1* 6/2016 Zhang ..... A61B 5/7246 600/301
2017/0069149 A1* 3/2017 Scheja ..... G07C 9/00023
2019/0076064 A1* 3/2019 Tahara ..... A61B 5/1176
2019/0081945 A1* 3/2019 Chiang ..... H04L 63/0861
2019/0180539 A1* 6/2019 Alkhabbaz ..... G07C 9/00158

* cited by examiner

*Primary Examiner* — An T Nguyen
(74) *Attorney, Agent, or Firm* — Alan D. Kamrath; Mayer & Williams PC

(57) ABSTRACT

A control system for door access control and personal physiological monitoring includes a portable access device for setting a door access control device to an unlocking state. When a person enters a high-risk area, the portable access device continuously monitors at least one physiological value of the person and sends the at least one physiological value to a control center. The control center determines whether the person can stay in the high-risk area according to a physiological state of the person based on the at least one physiological value. Control methods for door access control and personal physiological monitoring are also provided.

19 Claims, 5 Drawing Sheets

CONTROL SYSTEM AND CONTROL METHOD FOR DOOR ACCESS CONTROL AND PERSONAL PHYSIOLOGICAL MONITORING

BACKGROUND OF THE INVENTION

The present invention relates to a control system and a control method for door access control and personal physiological monitoring and, more particularly, to a control system and a control method for controlling access to a space, such as a room, and for monitoring a physiological state of a person.

Many spaces or rooms have a door at the entrance/exit, and the access is controlled by a door lock or an electric provision. Thus, a key is generally required to access a space or a room.

In modern industries, the environments of some processes risk from high temperature and leakage of chemicals (such as corrosive chemicals usually used in the electronic industry). Specifically, the body of a person in a high-temperature environment could be too uncomfortable to keep on working, whereas a person in a room with the risk of chemical leakage could feel uncomfortable by poisonous chemicals leaked during operation. Although access control can be provided to a high-temperature room and a room in which chemicals are used in processes, the physiological condition of the person in the room cannot be checked in time to determine whether the person is still able to keep on working, and there are occasional casualty reports of injury and/or death of persons in factories due to poisoning.

BRIEF SUMMARY OF THE INVENTION

In a first aspect, the present invention provides a control method for door access control and personal physiological monitoring, with the control method comprising:

reading an locking information in a portable access device of a person by a first door access control device configured to control access to a first space, wherein the first door access control device remains in a locking state not permitting access to the first space when identification of the unlocking information is unsuccessful, and the portable access device does not monitor at least one physiological value of the person and does not report the at least one physiological value;

executing an unlocking procedure with the first door access device when the identification of the unlocking information is successful, permitting access to the first space;

monitoring the at least one physiological value of the person with the portable access device and reporting the at least one physiological value of the person to a control center after the first door access control device has executed the unlocking procedure; and determining whether the at least one physiological value received by the control center is abnormal, wherein an alarm message is sent out when the at least one physiological value is determined to be abnormal after analysis by the control center, and wherein no alarm message is sent out when the at least one physiological value is determined to be normal after analysis by the control center.

In an example, the portable access device includes a biological feature capturing unit and an electronic paper, and the first door access control device includes a reading unit. When the person has no intention to access the first space, the person does not use the biological feature capturing unit to input a biological feature of the person, and the electronic paper does not display the unlocking information. The person uses the biological feature capturing unit to input the biological feature when the person intends to access the first space. When identification of the biological feature inputted through the biological feature capturing unit is unsuccessful, the electronic paper does not display the unlocking information. When identification of the biological feature inputted through the biological feature capturing unit is successful, the electronic paper displays the unlocking information, and the reading unit of the first door access control device reads the unlocking information displayed by the electronic paper.

In an example, the at least one physiological value includes at least one of a heart rate, a blood pressure value, and a body temperature of the person.

In an example, the control method further includes obtaining the at least one physiological value of the person while the first door access control device is reading the unlocking information. The unlocking procedure is carried out when the identification of the unlocking information is successful and when the at least one physiological value is determined to be normal. The unlocking procedure is not carried out when the identification of the unlocking information is unsuccessful or when the at least one physiological value is determined to be abnormal.

In an example, the at least one physiological value is determined to be normal when the heart beat is in a range of 50-140 beats per minute, a systolic blood pressure is in a range of 90-150 mmHg, a diastolic blood pressure is in a range of 50-100 mmHg, and the body temperature is in a range of 36-39° C.

In an example, the alarm message is sent out by a personnel in the control center, and the personnel uses the control center to send the alarm message to a sound generating unit of the portable access device through wireless transmission to thereby generate an audio message.

In an example, the control method further includes detecting whether the portable access device is located in a physiological value detection area after activating monitoring of the at least one physiological value. A physiological state of the person based on the at least one physiological value is determined when the portable access device is located in the at least one physiological value detection area. When the portal access device is outside of the physiological value detection area, monitoring of the at least one physiological value is not activated.

In a second aspect, the present invention provides a control system for door access control and personal physiological monitoring, with the control system comprising:

a portable access device including a physiological monitoring unit configured to monitor at least one physiological value of a person holding the portable access device, wherein the portable access device further includes a sound generating unit configured to generate sound, wherein the portable access device further includes a main memory and a main wireless connection unit, and wherein an unlocking information is stored in the main memory;

a control center including a wireless connection control unit configured to connect with the main wires connection unit of the portable access device;

a first door access control device configured to be mounted to an outer side of a first space, configured to read the unlocking information, and configured to control access to the first space, wherein the first door access control device is switchable between a locking state not permitting access to the first space and an unlocking state permitting access to the first space, wherein when the unlocking information of the portable access device is identified by the first door access control device as being incorrect, the first door access control device remains in the locking state not permitting access to the first space, and the physiological monitoring unit does not monitor the at least one physiological value of the person, wherein when the unlocking information of the portable access device is identified by the first door access control device as being correct, the first door access control device is switched to the locking state permitting access to the first space, the physiological monitoring unit monitors the at least one physiological value of the person, and the physiological value is sent to the control center, and wherein the sound generating unit does not send out an alarm message when the control center determines that the at least one physiological value is normal, and wherein the sound generating unit sends out the alarm message when the control center determines that the at least one physiological value is abnormal.

In an example, the portable access device further includes a biological feature capturing unit configured to capture a biological feature of the person and an electronic paper. The first door access control device further includes a first reading unit configured to read the electronic paper. The electronic paper displays the unlocking information when the captured biological feature is identified by the portable access device as being correct. The electronic paper does not display the unlocking information when the captured biological feature is identified by the portable access device as being incorrect.

In another example, the portable access device further includes a biological feature capturing unit configured to capture a biological feature of the person and a transmission unit. The first door access control device further includes a first reading unit connectable with the transmission unit. The transmission unit transmits the unlocking information to the first reading unit when the captured biological feature is identified by the portable access device as being correct. The transmission unit does not transmit the unlocking information when the captured biological feature is identified by the portable access device as being incorrect.

In an example, the portable access device further includes a positioning and transmitting unit. The control center further includes a positioning and receiving unit connected to the positioning and transmitting unit. The positioning and transmitting unit reports a location of the portable access device to the positioning and receiving unit. The physiological monitoring unit continuously reports the at least one physiological value of the person to the control center when the portable access device is in the first space. The physiological monitoring unit does not report the at least one physiological value of the person to the control center when the portable access device is outside of the first space.

In an example, the control system further includes a second door access control device configured to be mounted to an outer side of a second space to control access to the second space. The second door access control device is switchable between a locking state not permitting access to the second space and an unlocking state permitting access to the second space. When the unlocking information of the portable access device is identified by the second door access control device as being incorrect, the second door access control device remains in the locking state not permitting access to the second space, and the physiological monitoring unit monitors the at least one physiological value of the person. When the unlocking information of the portable access device is identified by the second door access control device as being correct, the first door access control device is switched to the unlocking state permitting access to the second space, and the physiological monitoring unit does not monitor the at least one physiological value of the person.

In an example, the portal access device further includes an audio reception unit configured to receive an audio message of the person holding the portable access device. The control center further includes a microphone and a loudspeaker. The loudspeaker is configured to broadcast the audio message of the person. The microphone is configured to provide the control center with the alarm message through the sound generating unit.

In a third aspect, a control method is provided to control access to one of a first space and a second space and then access to another of the first space and the second space, wherein controlling access to the first space includes:

reading an locking information in a portable access device of a person by a first door access control device configured to control access to the first space, wherein the first door access control device remains in a locking state not permitting access to the first space when identification of the unlocking information is unsuccessful, and the portable access device does not monitor at least one physiological value of the person and does not report the at least one physiological value;

executing an unlocking procedure with the first door access device when the identification of the unlocking information is successful, permitting access to the first space;

monitoring the at least one physiological value of the person with the portable access device and reporting the at least one physiological value of the person to a control center after the first door access control device has executed the unlocking procedure; and determining whether the at least one physiological value received by the control center is abnormal, wherein an alarm message is sent out when the at least one physiological value is determined to be abnormal after analysis by the control center, and wherein no alarm message is sent out when the at least one physiological value is determined to be normal after analysis by the control center, wherein controlling access to the second space includes:

reading the locking information in the portable access device of the person by a second door access control device configured to control access to the second space, wherein the second door access control device remains in a locking state not permitting access to the second space when identification of the unlocking information is unsuccessful; and executing an unlocking procedure with the second door access device when the identification of the unlocking information is successful, permitting access to the second space.

In an example, wherein the portable access device includes a biological feature capturing unit and an electronic paper, wherein the first door access control device includes a reading unit. When the person has no intention to access the first space, the person does not use the biological feature capturing unit to input a biological feature of the person, and the electronic paper does not display the unlocking information. When identification of the biological feature inputted through the biological feature capturing unit is unsuccessful, the electronic paper does not display the unlocking information. When identification of the biological feature inputted through the biological feature capturing unit is successful, the electronic paper displays the unlocking information, and the reading unit of the first door access control device reads the unlocking information displayed by the electronic paper.

The control method and the control system according to the present invention utilizes the first and second door access control devices to identify whether a person is entering a high-risk operating area. Furthermore, after the person has entered the high-risk operating area, the report and monitoring of the at least one physiological value assure the person to operate in the high-risk operating area without health risks, improving the operational safety of the person while providing the door access effect.

The present invention will become clearer in light of the following detailed description of illustrative embodiments of this invention described in connection with the drawings.

Figure 1:
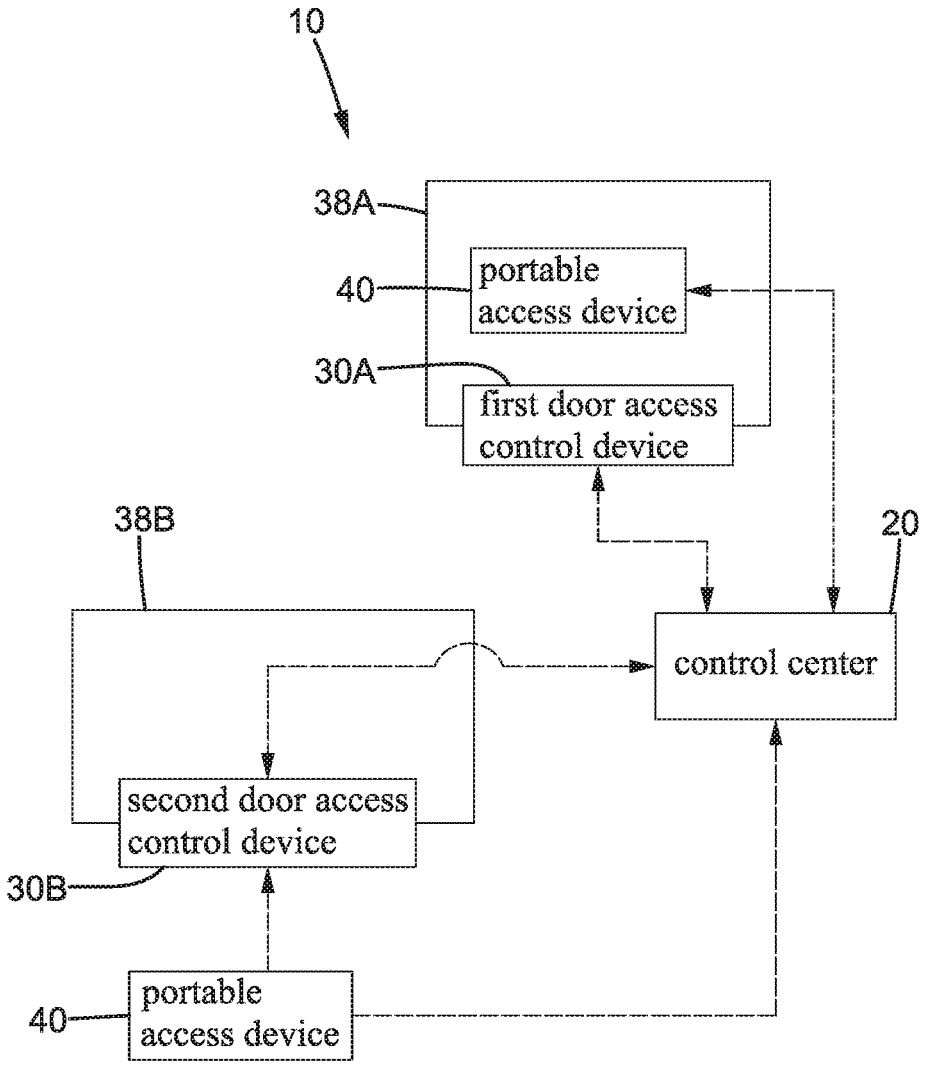
FIG. 1 is a diagrammatic block diagram illustrating use of a control system for door access control and personal physiological monitoring according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "inner", "outer", "side", "portion", "space", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
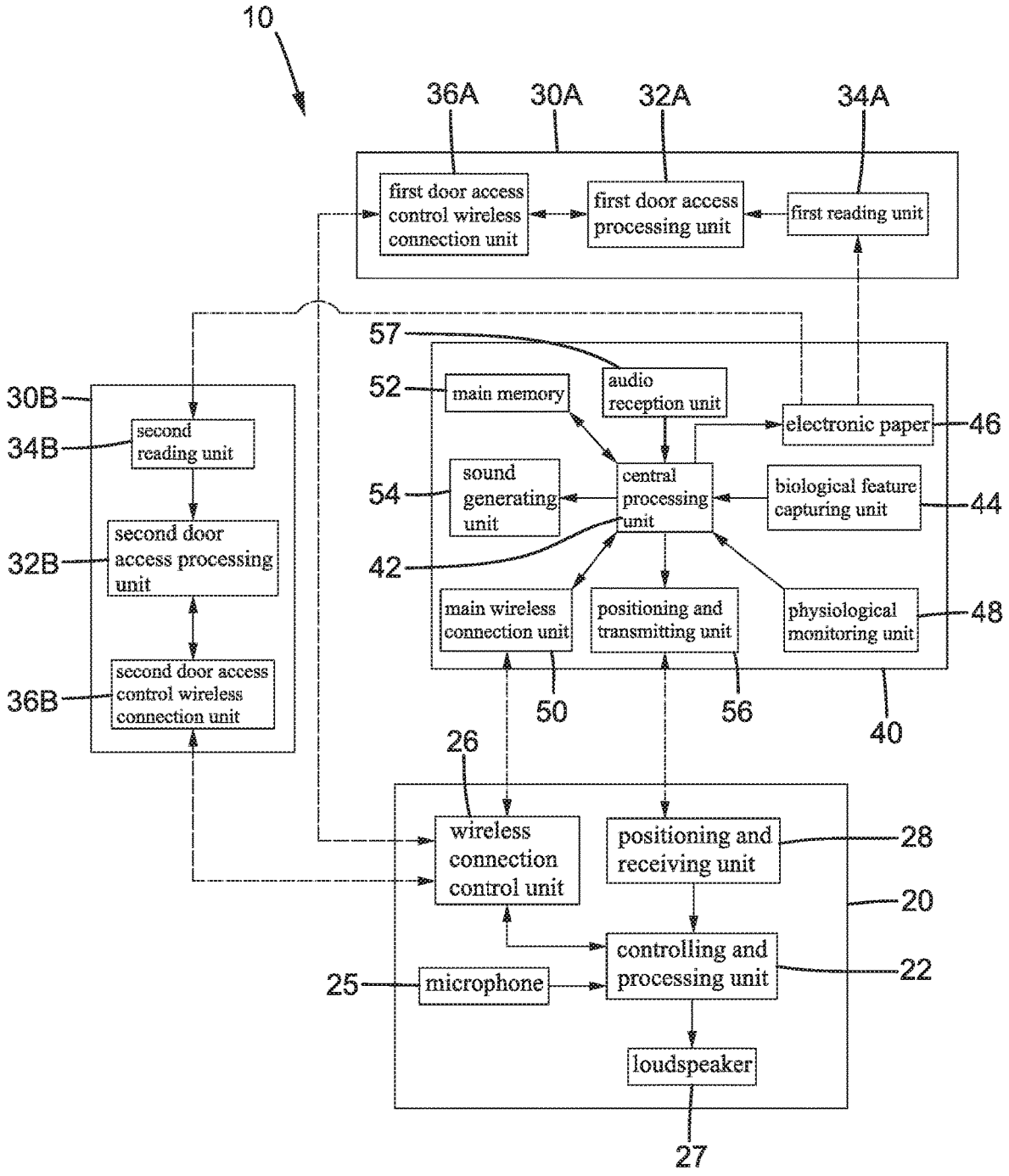
FIG. 2 is a diagrammatic block diagram illustrating a control system for door access control and personal physiological monitoring of a first embodiment according to the present invention.

A control system 10 and a control method for door access control and personal physiological monitoring according to the present invention can determine whether a person is allowed to enter an access-controlled space and can further monitor physiological values of the person to determine whether the person can still remain in the access-controlled space. With reference to FIGS. 1 and 2, the control system 10 includes a control center 20. The control center 20 includes a controlling and processing unit 22, a wireless connection control unit 26 electrically connected to the controlling and processing unit 22, and a positioning and receiving unit 28 electrically connected to the controlling and processing unit 22. The control center 20 further includes a microphone 25 electrically connected to the controlling and processing unit 22 and configured to receive sound. The control center 20 further includes a loudspeaker 27 electrically connected to the controlling and processing unit 22 and configured to broadcast.

The control system 10 further includes a portable access device 40, a first door access control device 30A, and a second door access control device 30B. The portable access device 40 includes a central processing unit 42, a biological feature capturing unit 44 electrically connected to the central processing unit 42 and configured to capture a biological feature, and a main memory 52. The portable access device 40 further includes a sound generating unit 54 electrically connected to the central processing unit 42, a main wireless connection unit 50 electrically connected to the central processing unit 42, a positioning and transmitting unit 56 electrically connected to the central processing unit 42, and an audio reception unit 57 electrically connected to the central processing unit 42. The portable access device 40 further includes a physiological monitoring unit 48 electrically connected to the central processing unit 42 and configured to detect at least one physiological value of a holder, and an electronic paper 46 electrically connected to the central processing unit 42. The sound generating unit 54 can be a small loudspeaker capable of generating sound. The positioning and transmitting unit 56 is configured to report a position of the portable access device 40. The electronic paper 46 is configured to display an unlocking information. The main wireless connection unit 50 is configured to connect with the wireless connection control unit 26 of the control center 20. The main memory 52 stores a biological feature verification information that is inputted in advance and an unlocking information that can be identical to or different from the biological feature verification information. The audio reception unit 57 can be a microphone.

The physiological monitoring unit 48 is used to detect physiological values (such as the heart rate, the blood pressure, the body temperature, etc.) of a holder. A heart rate in a range of 50-140 beats per minute, a systolic blood pressure in a range of 90-150 mmHg, a diastolic blood pressure in a range of 50-100 mmHg, and a body temperature in a range of 36-39° C. are deemed as normal. A physiological value above or lower than the corresponding threshold is deemed as abnormal.

The first door access control device 30A is mounted to an outer side of a first space 38A to control access to the first space 38A. The first door access control device 30A includes a first door access processing unit 32A, a first reading unit 34A electrically connected to the first door access processing unit 32A, and a first door access control wireless connection unit 36A electrically connected to the first door access processing unit 32A. The first reading unit 34A is used to read the unlocking information displayed on the electronic paper 46. The first reading unit 34A can be an image capturing unit, such as a camera. The first door access control wireless connection unit 36A is used to connect with the wireless connection control unit 26.

The second door access control device 30B is mounted to an outer side of a second space 38B to control access to the second space 38B. The second door access control device 30B includes a second door access processing unit 32B, a second reading unit 34B electrically connected to the second door access processing unit 32B, and a second door access control wireless connection unit 36B electrically connected to the second door access processing unit 32B. The second reading unit 34B is used to read the unlocking information displayed on the electronic paper 46. The second reading unit 34B can be an image capturing unit, such as a camera. The second door access control wireless connection unit 36B is used to connect with the wireless connection control unit 26.

For the sake of explanation, it will be assumed that the first space 38A to which the first door access control device 30A is mounted is a high-risk environment and that the second space 38B to which the second door access control device 30B is a normal room. The high-risk environment is an operating environment at a high temperature or a low temperature (such as below 0° C.), and a physiological state of a person in such a high-risk environment is not good and could be highly risky.

Figure 3:
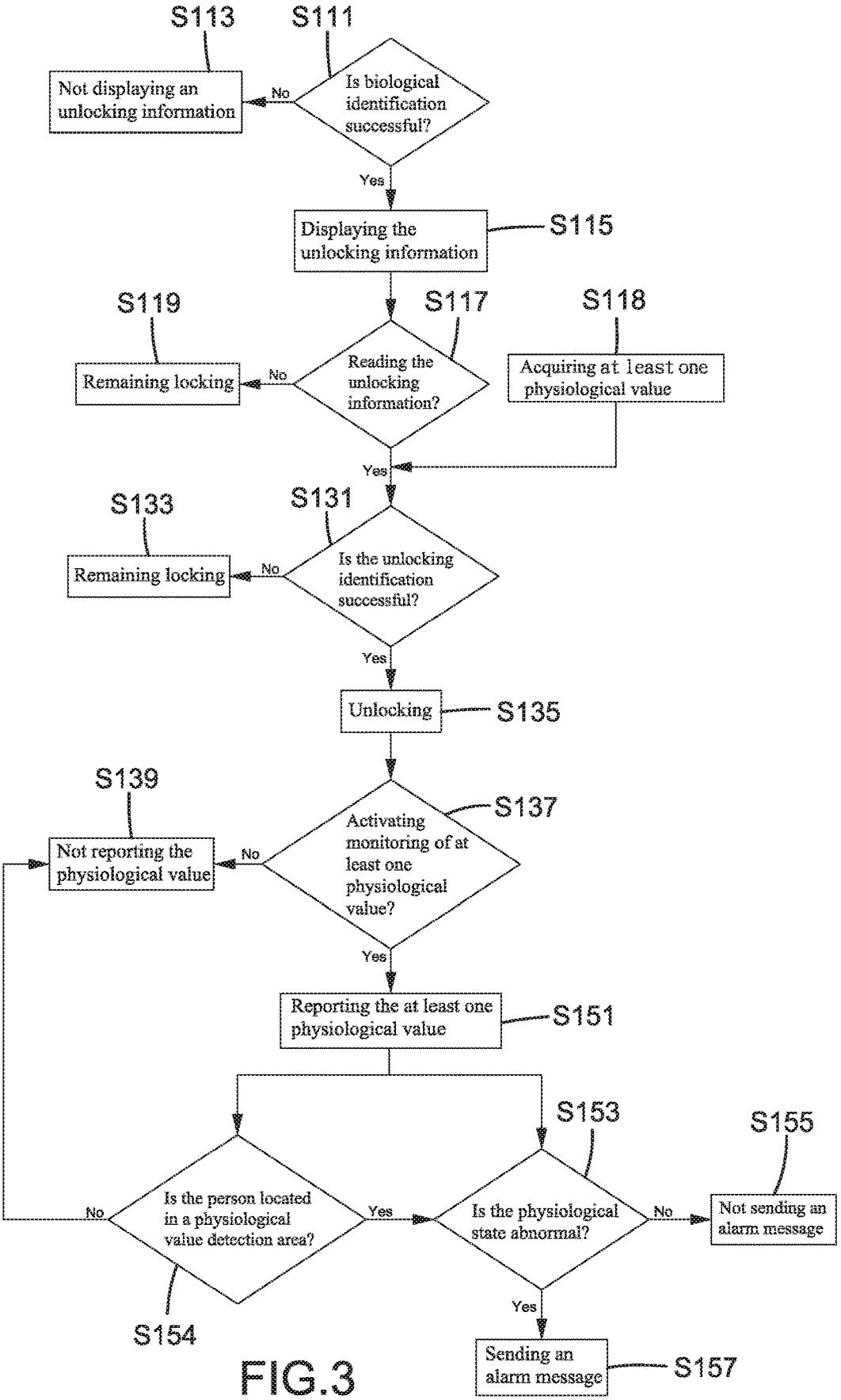
FIG. 3 is a flowchart illustrating a control method for door access control and personal physiological monitoring of an embodiment according to the present invention.

With reference to FIG. 3, a control method for door access control and personal physiological monitoring according to the present invention includes determining whether a biological identification is successful (step S111). Specifically, when a person has no intention to pass through the access control, the person will not use the biological feature capturing unit 44 to input his or her own biological feature, such that the electronic paper 46 will not display the unlocking information. On the other hand, when the person intends to pass through the first or second door access control device 30A or 30B, the person uses the biological feature capturing unit 44 to input his or her own biological feature. The central processing unit 42 of the portable access device 40 identifies whether the captured biological feature is identical to the biological feature verification information stored in the main memory 52. When the captured biological feature is not identical to the biological feature verification information, the biological identification is unsuccessful, and the electronic paper 46 does not display the unlocking information (step S113). On the other hand, when the captured biological feature is identical to the biological feature verification information, the biological identification is successful, and the electronic paper 46 displays the unlocking information (step S115).

In step S117, it is determined whether to read the unlocking information. Specifically, when the person has no intention to pass through the access control, the unlocking information is not read, and the first or second door access control device 30A or 30B remains in the locking state. On the other hand, when the person intends to pass through (and stands near) the first door access control device 30A, the unlocking information of the electronic paper 46 on the portable access device 40 is read by the first door access control device 30A. Specifically, the person places the electronic paper 46 near the first door access control device 30A, such that the first reading unit 34A acquires the image displayed on the electronic paper 46. The situation of access to the second space 38B controlled by the second door access control device 30B is similar, except that the image displayed on the electronic paper 46 is read by the second reading unit 34B.

While the unlocking information is being read by the first door access control device 30A, the physiological monitoring unit 48 of the portable access device 40 obtains at least one physiological value of the person (step S118), and the at least one physiological value is transmitted to the control center 20 via the main wireless connection unit 50 and the wireless connection control unit 26. In the case of access to the second space 38B, when the unlocking information is being read by the second door access control device 30B, the portable access device 40 does not acquire any physiological value of the person.

In step S131, it is determined whether the unlocking identification is successful. Specifically, in the case of access to the first space 38A, when the first door access control device 30A identifies that the unlocking information is not read successfully or when the control center 20 determines that the at least one physiological value is abnormal, the first door access control device 30A remains in the locking state (step S133). The first door access control device 30A executes an unlocking procedure (S135) only when the first door access control device 30A identifies that the unlocking information is read successfully and when the control center 20 determines that the at least one physiological value is normal. In the case of access to access to the second space 38B, when the second door access control device 30B identifies that the unlocking information is not read successfully, the second door access control device 30B remains in the locking state (step S133). The second door access control device 30B executes the unlocking procedure (S135) when the second door access control device 30B identifies that the unlocking information is read successfully. Since the second space 38B controlled by the second door access control device 30B is an undangerous, normal room, when the person chooses to pass through the second door access control device 30B, the portable access device 40 will not acquire the physiological values. Nevertheless, since the first space 38A controlled by the first door access control device 30A is a dangerous space or room, the portable access device 40 will activate the physiological monitoring unit 48 to acquire the at least one physiological value of the person intending to enter the first space 38A and will send the at least one physiological value to the control center 20 to determine whether it is abnormal.

In step S137, it is determined whether to activate monitoring of the at least one physiological value. Specifically, in the case of access to the first space 38A, when the first door access control device 30A does not execute the unlocking procedure S135, the portable access device 40 will not monitor the physiological values and will not report the physiological values (step S139). On the other hand, after the first door access control device 30A executes the unlocking procedure and reports the at least one physiological value, the portable access device 40 starts to continuously monitor the at least one physiological value and reports the at least one physiological value to the control center 20 (S151).

In step S154, it is determined whether the portable access device 40 is still located in a physiological value detection area after activation of monitoring the at least one physiological value. Specifically, when the portable access device 40 is in the physiological value detection area (which is the first space 38A in this embodiment), the physiological monitoring unit 48 continuously monitor the at least one physiological value of the person and sends the at least one physiological value to the control center 20. The control center determines whether the at least one physiological value is abnormal (step S153). On the other hand, when the portable access device 40 is outside of the physiological value detection area, the at least one physiological value is not reported (step S139), and monitoring of the physiological values is not activated.

In step S153, the control center 20 analyzes whether the received at least one physiological value of the person is abnormal. When the at least one physiological value of the person is determined to be normal, no alarm message is sent to the person (step S155). When the control center 20 identifies that the at least one physiological value is in the normal range (e.g., the heart rate is in a range of 50-140 beats per minute, the systolic blood pressure is in a range of 90-150 mmHg, the diastolic blood pressure is in a range of 50-100 mmHg, and the body temperature is in a range of 36-39° C.), the control center 20 does not send out the alarm message (step S155). On the other hand, when the control center 20 identifies that the at least one physiological value is beyond the normal range, the sound generating unit 54 of the portable access device 40 generates an audio alarm (step S157). The audio alarm can be a verbal message from the personnel (in the control center 20) using the microphone 25 and is transmitted to the sound generating unit 54 of the portable access device 40 via the wireless connection control unit 26 and the main wireless connection unit 50. Furthermore, the person can use the audio reception unit 57 to communicate with the control center 20, and the control center 20 can broadcast the audio message of the person through the loudspeaker 27.

Figure 4:
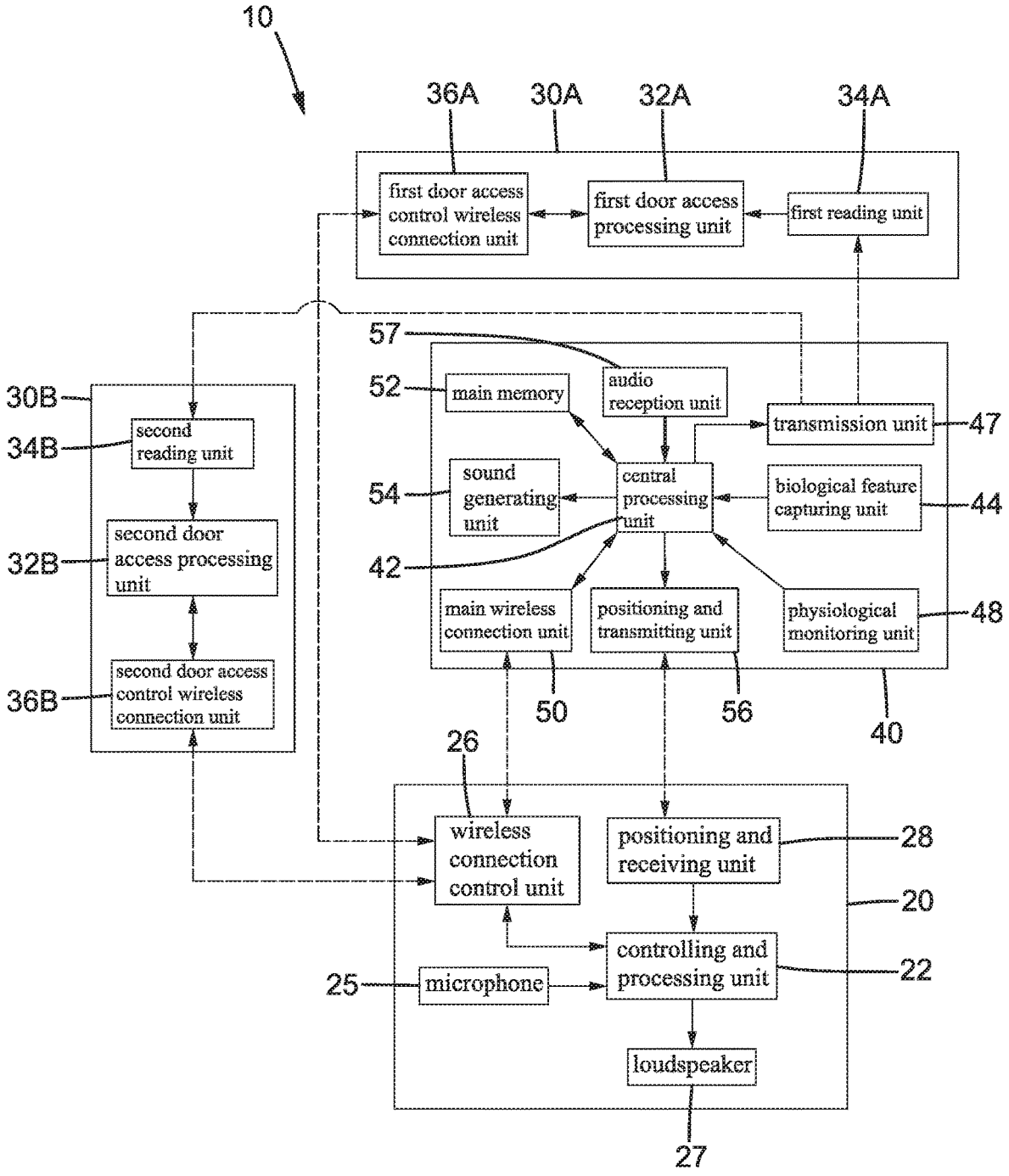
FIG. 4 is a diagrammatic block diagram illustrating a control system for door access control and personal physiological monitoring of a second embodiment according to the present invention.

With reference to FIG. 4, the electronic paper 46 showing the unlocking information can be replaced by a transmission unit 47. The first reading unit 34A of the first door access control device 30A and the second reading unit 34B of the second door access control device 30B can be wireless devices (such as radio frequency identification devices, Bluetooth, near field communication devices, etc.) connectable with the transmission unit 47. When the captured biological feature is identified by the portable access device 40 as being correct, the unlocking information is transmitted by the transmission unit 47 to the first or second door access control device 30A or 30B. In the embodiment shown in FIG. 4, the control method does not have to include steps S111, S113, and S115.

Figure 5:
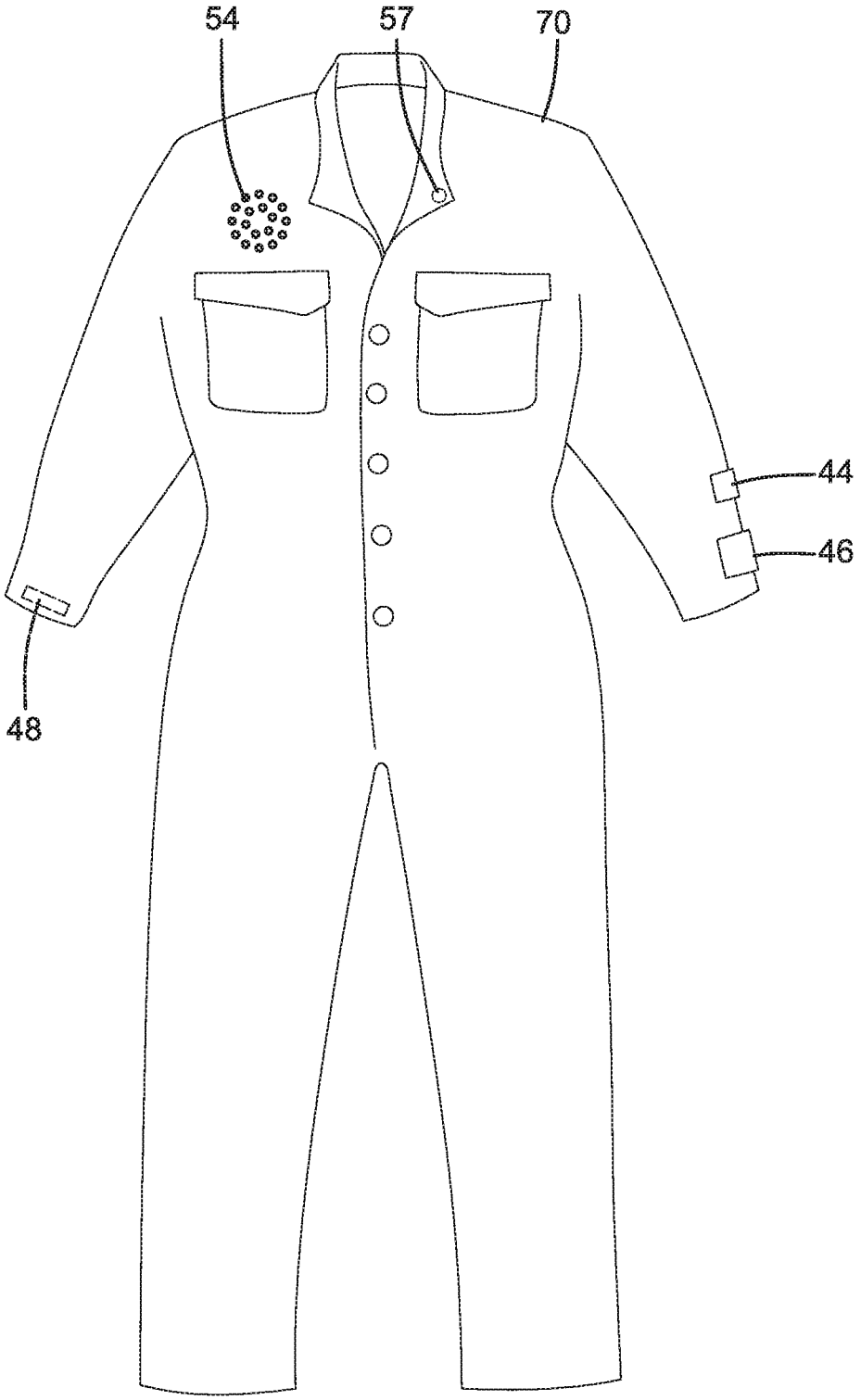
FIG. 5 is a diagrammatic view of work clothes using the control system for door access control and personal physiological monitoring according to the present invention.

The portable access device 40 can be work clothes 70 or any type of clothes, as shown in FIG. 5. The electronic paper 46 and the biological feature capturing unit 44 are disposed on an outer side of a sleeve of the work clothes 70 and are adjacent to an opening of the sleeve. The physiological monitoring unit 48 is disposed on an inner side of another sleeve of the work clothes 70 and is configured to contact with a skin of a person wearing the work clothes 70 for measuring at least one physiological value of the person. Other units of the portable access device 40 can be fixed on the work clothes 70 (such as the front chest pocket area). The sound generating unit 54 is disposed on an area of the work clothes 70 adjacent to the chest, and the audio reception unit 57 is disposed on a collar of the work clothes 70. When worn on an operator of a company, the work cloths 70 can detect the location and the at least one physiological value of the operator and can provide the operator with a door access function. The portable access device 40 can be implemented into other forms. For example, the portable access device 40 can be integrated with a smart watch or can be a small personal device per se.

The control method and the control system 10 according to the present invention utilizes the first and second door access control devices 30A and 30B to identify whether a person is entering a high-risk operating area. Furthermore, after the person has entered the high-risk operating area, the report and monitoring of the at least one physiological value assure the person to operate in the high-risk operating area without health risks, improving the operational safety of the person while providing the door access effect.

The portable access device 40 displays the unlocking information (FIG. 2) after a successful biological identification, such that the portable access device 40 can be used by a certain person, which is useful in managing a list of authorized persons.

Now that the basic teachings of the present invention have been explained, many extensions and variations will be obvious to one having ordinary skill in the art. For example, the control method and the control system 10 according to the present invention do not have to include the second door access device 30B and the second space 38B. Furthermore, the control method can be used to verify the identity of a plurality of persons entering the same space, such as the first space 38A. Furthermore, the alarm message can be sent to the personnel in the control center 20 or a personnel manager. In a case that one or more of the plurality of persons has an abnormal physiological value, the alarm message is only sent to the one or more of the plurality of persons.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A control method for door access control and personal physiological monitoring, comprising:

reading an locking information in a portable access device of a person by a first door access control device configured to control access to a first space, wherein the first door access control device remains in a locking state not permitting access to the first space when identification of the unlocking information is unsuccessful, and the portable access device does not monitor at least one physiological value of the person and does not report the at least one physiological value;

executing an unlocking procedure with the first door access device when the identification of the unlocking information is successful, permitting access to the first space;

monitoring the at least one physiological value of the person with the portable access device and reporting the at least one physiological value of the person to a control center after the first door access control device has executed the unlocking procedure; and determining whether the at least one physiological value received by the control center is abnormal, wherein an alarm message is sent out when the at least one physiological value is determined to be abnormal after analysis by the control center, and wherein no alarm message is sent out when the at least one physiological value is determined to be normal after analysis by the control center.

2. The control method as claimed in claim 1, wherein the portable access device includes a biological feature capturing unit and an electronic paper, wherein the first door access control device includes a reading unit, wherein when the person has no intention to access the first space, the person does not use the biological feature capturing unit to input a biological feature of the person, and the electronic paper does not display the unlocking information, wherein the person uses the biological feature capturing unit to input the biological feature when the person intends to access the first space, wherein when identification of the biological feature inputted through the biological feature capturing unit is unsuccessful, the electronic paper does not display the unlocking information, and wherein when identification of the biological feature inputted through the biological feature capturing unit is successful, the electronic paper displays the unlocking information, and the reading unit of the first door access control device reads the unlocking information displayed by the electronic paper.

3. The control method as claimed in claim 1, wherein the at least one physiological value includes at least one of a heart rate, a blood pressure value, and a body temperature of the person.

4. The control method as claimed in claim 3, further comprising obtaining the at least one physiological value of the person while the first door access control device is reading the unlocking information, wherein the unlocking procedure is carried out when the identification of the unlocking information is successful and when the at least one physiological value is determined to be normal, and wherein the unlocking procedure is not carried out when the identification of the unlocking information is unsuccessful or when the at least one physiological value is determined to be abnormal.

5. The control method as claimed in claim 4, wherein the at least one physiological value is determined to be normal when the heart beat is in a range of 50-140 beats per minute, a systolic blood pressure is in a range of 90-150 mmHg, a diastolic blood pressure is in a range of 50-100 mmHg, and the body temperature is in a range of 36-39° C.

6. The control method as claimed in claim 1, wherein the alarm message is sent out by a personnel in the control center, wherein the personnel uses the control center to send the alarm message to a sound generating unit of the portable access device through wireless transmission to thereby generate an audio message.

7. The control method as claimed in claim 1, further comprising detecting whether the portable access device is located in a physiological value detection area after activating monitoring of the at least one physiological value, wherein a physiological state of the person based on the at least one physiological value is determined when the portable access device is located in the at least one physiological value detection area, and wherein when the portal access device is outside of the physiological value detection area, monitoring of the at least one physiological value is not activated.

8. A control system for door access control and personal physiological monitoring, comprising:

a portable access device including a physiological monitoring unit configured to monitor at least one physiological value of a person holding the portable access device, wherein the portable access device further includes a sound generating unit configured to generate sound, wherein the portable access device further includes a main memory and a main wireless connection unit, and wherein an unlocking information is stored in the main memory;

a control center including a wireless connection control unit configured to connect with the main wires connection unit of the portable access device;

a first door access control device configured to be mounted to an outer side of a first space, configured to read the unlocking information, and configured to control access to the first space, wherein the first door access control device is switchable between a locking state not permitting access to the first space and an unlocking state permitting access to the first space, wherein when the unlocking information of the portable access device is identified by the first door access control device as being incorrect, the first door access control device remains in the locking state not permitting access to the first space, and the physiological monitoring unit does not monitor the at least one physiological value of the person, wherein when the unlocking information of the portable access device is identified by the first door access control device as being correct, the first door access control device is switched to the locking state permitting access to the first space, the physiological monitoring unit monitors the at least one physiological value of the person, and the physiological value is sent to the control center, and wherein the sound generating unit does not send out an alarm message when the control center determines that the at least one physiological value is normal, and wherein the sound generating unit sends out the alarm message when the control center determines that the at least one physiological value is abnormal.

9. The control system as claimed in claim 8, wherein the portable access device further includes a biological feature capturing unit configured to capture a biological feature of the person and an electronic paper, wherein the first door access control device further includes a first reading unit configured to read the electronic paper, wherein the electronic paper displays the unlocking information when the captured biological feature is identified by the portable access device as being correct, and wherein the electronic paper does not display the unlocking information when the captured biological feature is identified by the portable access device as being incorrect.

10. The control system as claimed in claim 8, wherein the portable access device further includes a biological feature capturing unit configured to capture a biological feature of the person and a transmission unit, wherein the first door access control device further includes a first reading unit connectable with the transmission unit, wherein the transmission unit transmits the unlocking information to the first reading unit when the captured biological feature is identified by the portable access device as being correct, and wherein the transmission unit does not transmit the unlocking information when the captured biological feature is identified by the portable access device as being incorrect.

11. The control system as claimed in claim 8, wherein the portable access device further includes a positioning and transmitting unit, wherein the control center further includes a positioning and receiving unit connected to the positioning and transmitting unit, wherein the positioning and transmitting unit reports a location of the portable access device to the positioning and receiving unit, wherein the physiological monitoring unit continuously reports the at least one physiological value of the person to the control center when the portable access device is in the first space, and wherein the physiological monitoring unit does not report the at least one physiological value of the person to the control center when the portable access device is outside of the first space.

12. The control system as claimed in claim 8, further comprising:

a second door access control device configured to be mounted to an outer side of a second space to control access to the second space, wherein the second door access control device is switchable between a locking state not permitting access to the second space and an unlocking state permitting access to the second space, wherein when the unlocking information of the portable access device is identified by the second door access control device as being incorrect, the second door access control device remains in the locking state not permitting access to the second space, and the physiological monitoring unit monitors the at least one physiological value of the person, wherein when the unlocking information of the portable access device is identified by the second door access control device as being correct, the first door access control device is switched to the unlocking state permitting access to the second space, and the physiological monitoring unit does not monitor the at least one physiological value of the person.

13. The control system as claimed in claim 8, wherein the portal access device further includes an audio reception unit configured to receive an audio message of the person holding the portable access device, wherein the control center further includes a microphone and a loudspeaker, wherein the loudspeaker is configured to broadcast the audio message of the person, and wherein the microphone is configured to provide the control center with the alarm message through the sound generating unit.

14. A control method for controlling access to one of a first space and a second space and then access to another of the first space and the second space, wherein controlling access to the first space includes:

reading an locking information in a portable access device of a person by a first door access control device configured to control access to the first space, wherein the first door access control device remains in a locking state not permitting access to the first space when identification of the unlocking information is unsuccessful, and the portable access device does not monitor at least one physiological value of the person and does not report the at least one physiological value;

executing an unlocking procedure with the first door access device when the identification of the unlocking information is successful, permitting access to the first space;

monitoring the at least one physiological value of the person with the portable access device and reporting the at least one physiological value of the person to a control center after the first door access control device has executed the unlocking procedure; and determining whether the at least one physiological value received by the control center is abnormal, wherein an alarm message is sent out when the at least one physiological value is determined to be abnormal after analysis by the control center, and wherein no alarm message is sent out when the at least one physiological value is determined to be normal after analysis by the control center, wherein controlling access to the second space includes:

reading the locking information in the portable access device of the person by a second door access control device configured to control access to the second space, wherein the second door access control device remains in a locking state not permitting access to the second space when identification of the unlocking information is unsuccessful; and executing an unlocking procedure with the second door access device when the identification of the unlocking information is successful, permitting access to the second space.

15. The control method as claimed in claim 14, wherein the portable access device includes a biological feature capturing unit and an electronic paper, wherein the first door access control device includes a reading unit, wherein when the person has no intention to access the first space, the person does not use the biological feature capturing unit to input a biological feature of the person, and the electronic paper does not display the unlocking information, wherein when identification of the biological feature inputted through the biological feature capturing unit is unsuccessful, the electronic paper does not display the unlocking information, and wherein when identification of the biological feature inputted through the biological feature capturing unit is successful, the electronic paper displays the unlocking information, and the reading unit of the first door access control device reads the unlocking information displayed by the electronic paper.

16. The control method as claimed in claim 14, wherein the at least one physiological value includes at least one of a heart rate, a blood pressure value, and a body temperature of the person.

17. The control method as claimed in claim 16, further comprising obtaining the at least one physiological value of the person while the first door access control device is reading the unlocking information, wherein the unlocking procedure is carried out when the identification of the unlocking information is successful and when the at least one physiological value is determined to be normal, and wherein the unlocking procedure is not carried out when the identification of the unlocking information is unsuccessful or when the at least one physiological value is determined to be abnormal.

18. The control method as claimed in claim 14, wherein the alarm message is sent out by a personnel in the control center, wherein the personnel uses the control center to send the alarm message to a sound generating unit of the portable access device through wireless transmission to thereby generate an audio message.

19. The control method as claimed in claim 14, further comprising detecting whether the portable access device is located in a physiological value detection area after activating monitoring of the at least one physiological value, wherein a physiological state of the person based on the at least one physiological value is determined when the portable access device is located in the at least one physiological value detection area, and wherein when the portal access device is outside of the physiological value detection area, monitoring of the at least one physiological value is not activated.

* * * * *